United States Patent [19]

Partridge et al.

[11] 3,964,406

[45] June 22, 1976

[54] WASTE DISPOSAL APPARATUS

[76] Inventors: Arnold Brown Partridge, 3315 Maroneal St., Houston, Tex. 77025; Joseph Frank Woerner, 823 Azalea, Houston, Tex. 77018

[22] Filed: Jan. 24, 1975

[21] Appl. No.: 543,956

[52] U.S. Cl. ..... 110/8 A; 110/40 R; 110/119; 110/173 R

[51] Int. Cl.[2] ..... F23G 5/00

[58] Field of Search ..... 110/8 R, 8 A, 8 C, 8 P, 110/15, 18 R, 18 C, 119, 40, 173

[56] References Cited

UNITED STATES PATENTS

| | | | |
|---|---|---|---|
| 1,442,116 | 1/1923 | Balmer | 110/8 |
| 2,008,884 | 7/1935 | Tuppen | 110/15 |
| 3,333,556 | 8/1967 | Iacobovici | 110/15 |
| 3,515,078 | 6/1970 | Maitilasso | 110/40 X |
| 3,626,461 | 12/1971 | Munk | 110/8 |
| 3,668,833 | 6/1972 | Cahill, Jr. | 110/8 |
| 3,774,555 | 11/1973 | Turner | 110/15 |

*Primary Examiner*—Kenneth W. Sprague
*Attorney, Agent, or Firm*—Torres & Berryhill

[57] ABSTRACT

An apparatus for disposing of waste by means of complete combustion including an endless moveable track for conveying the waste through the apparatus, means for depositing the waste on the track, a furnace system for burning the waste, and means for removing any resulting residue from the track.

9 Claims, 7 Drawing Figures

WASTE DISPOSAL APPARATUS

BACKGROUND OF THE INVENTION

In the past, many different apparatus for disposing of waste have been used and have included various types which involved combustion of the waste. However, in the past, such apparatus did not always meet the enviornmental requirements desired by the present day ecological standards. The purpose of the present invention is to provide a suitable waste disposal system which will meet the present enviornmental requirements.

SUMMARY OF THE INVENTION

The apparatus of the present invention generally provides a means of disposing of waste by complete combustion in a manner which will meet the present enviornmental requirements of the federal and local governments. The apparatus includes an endless moveable track for conveying the waste through the apparatus, means for depositing the waste on the track, a furnace system for burning the waste, and means for removing any resulting residue from the track.

It is, therefore, an object of the present invention to provide an apparatus for disposing of waste by means of complete combustion including an endless moveable track for conveying the waste through the device, means for depositing the waste on the track, a furnace system for burning the waste, and means for removing any resulting residue from the track.

Another object of the present invention is the provision of a leveler under which the waste must pass prior to entering the furnace system, thereby maintaining a maximum allowable height of waste which may enter the furnace system at any given time.

A further object of the present invention is the provision of a furnace system which includes a primary burner area for burning the waste, a secondary burner area, i.e., the afterburner area, for burning any gaseous materials remaining after burning has occurred in the primary burner area, appropriate means for passing the unburned gaseous materials from the primary burner area to the afterburner area, and means for removing any emissions remaining after burning in the afterburner area.

A further object of the present invention is the provision of a furnace system wherein the means for disposing of the emissions remaining after burning in the afterburner area includes at least one smokestack, at least one in-draft suction fan located in the smokestack, at least one pipe through which the emissions exit from the afterburner area by means of negative pressure created in the in-draft suction fan, at least one water scrubber or water baffle located within the pipe.

Still another object of the present invention is the provision of a system for disposing of waste by means of complete combustion wherein roller gates are located at the entrance to the furnace area and at the exit from the furnace area, each roller gate being located upon springs or other appropriate means to allow adjustment of its height to that of the waste or residue upon the track.

Still other and further objects, features and advantages will be apparent from the following description of a presently-preferred embodiment of the invention, given for the purpose of disclosure and taken in conjunction with the accompanying drawings.

BRIEF DESCRIPTION OF THE DRAWINGS

In the drawings forming a part of the disclosure herein, like character references designate like parts throughout the several views, wherein.

DESCRIPTION OF THE PREFERRED EMBODIMENT

Figure 1:
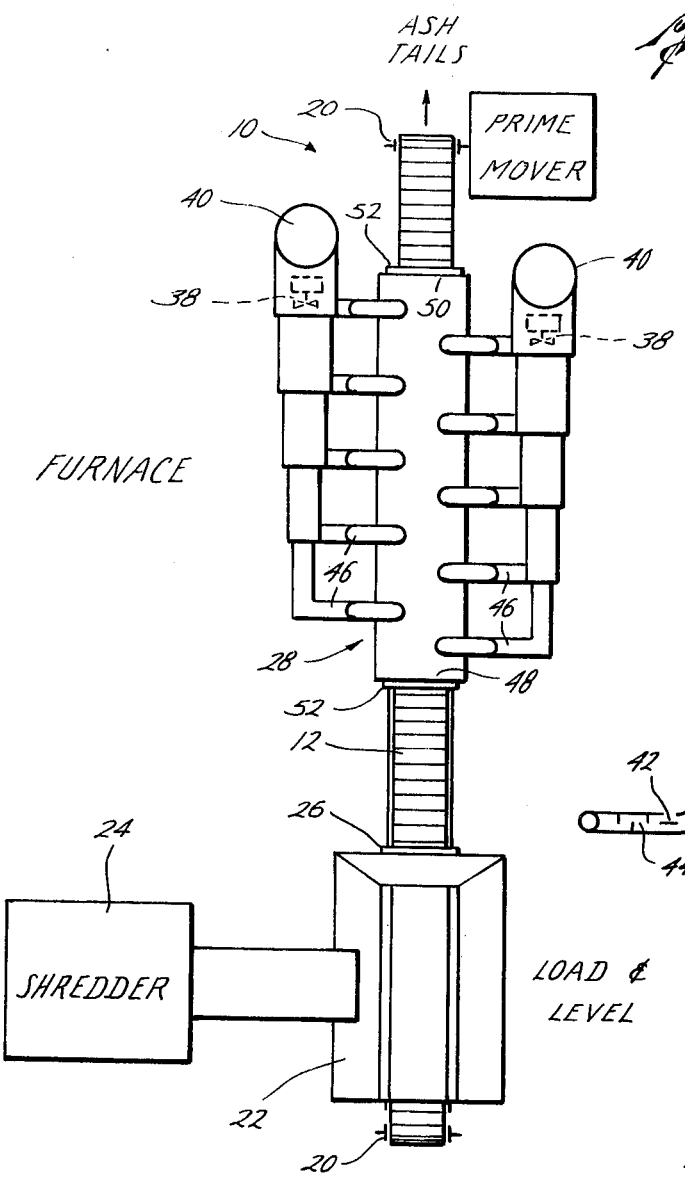
FIG. 1 is a top view of the present invention wherein the endless moveable track consists of a conveyor belt.
Figure 3:
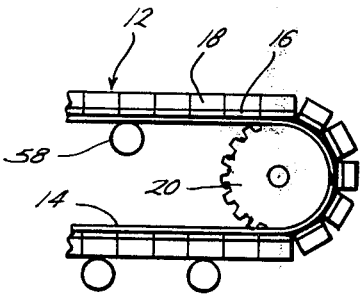
FIG. 3 is a partial side view of the conveyor belt.

Shown in FIG. 1 is a plan view of the present invention 10 as it might be used with a belt conveyor 12. As shown in FIG. 3, the belt conveyor 12 consists of an endless moveable belt which may be constructed of chain 14, metal plates 16 and refractory material 18 and which revolves around two moveably geared drums 20. At least one of the drums will be driven by appropriate means.

The waste enters a hopper 22 and is deposited upon the conveyor belt 12. However, prior to entry into the hopper, the waste may be fed through a shredder 24. The waste then passes under a leveler 26 which maintains a maximum height of waste for entry into the furnace system 28. The leveler 26 may simply consist of a rigid board or piece of metal which is set above the belt conveyor at the desired maximum height.

Figure 2:
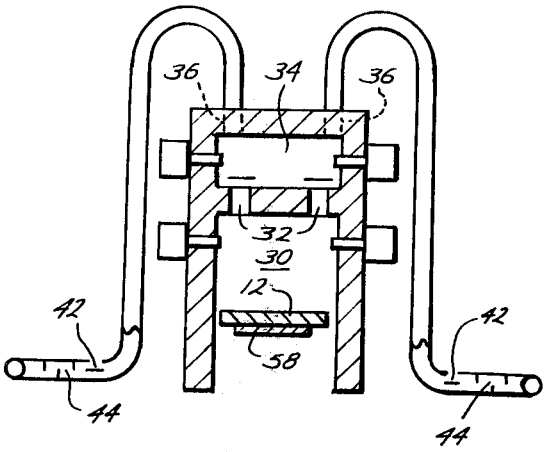
FIG. 2 is a front view, in section, of the furnace area of FIG. 1.

As shown in FIG. 2, the conveyor 12 enters into the primary burner area 30 of the furnace system 28. As the waste is burned in the primary burner, any remaining emissions escape through appropriate openings 32 to a second level 34 where afterburners are ignited. Any emissions which remain after having passed through the afterburner section 34 are forced into one or more passageways 36 by means of negative pressure which is created by in-draft suction fans 38 which are located in the smokestacks 40.

Prior to submitting the remaining emissions to the atmosphere by means of smokestacks 40, they pass through a water scrubber 42 and water baffles 44 which divert some of the emissions from the atmosphere. The number of emission outlets 46 from the afterburner section to the smokestacks will vary according to the amount of waste needed to be burned. As shown in the present drawings, ten outlets 46 are provided.

To prevent the escape of smoke and other substances from the front and rear ends 48 and 50 of the furnace system 28, roller gates 52 are located at both positions. Each of the roller gates 52 is positioned upon springs or other appropriate means which allow its height to be adjusted to the height of the incoming waste or the outgoing residue. Such adjustment of the heights of the respective roller gates 52 maintains the smoke, etc., within the furnace system 28.

Figure 6:
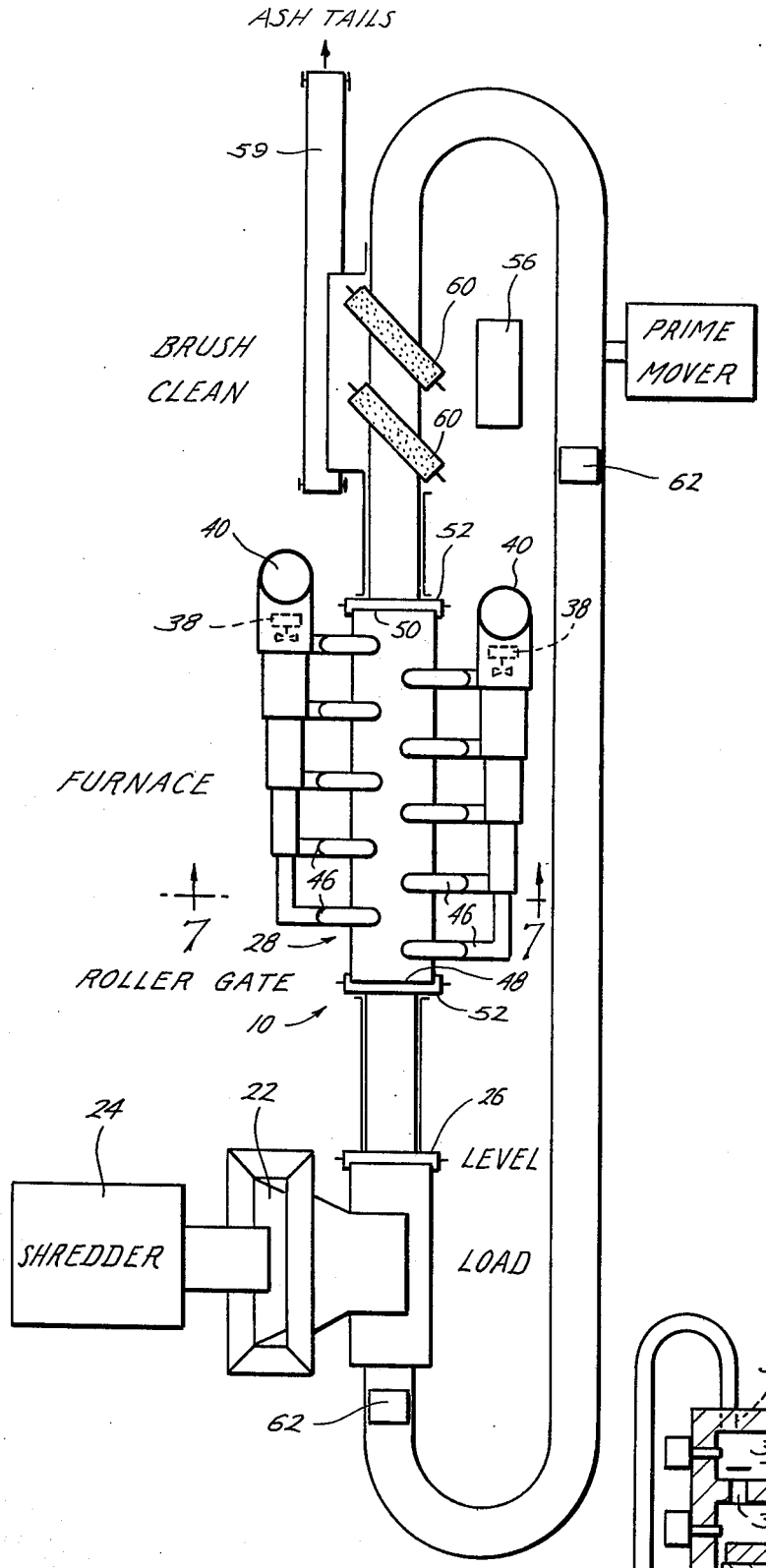
FIG. 6 is a top view of the present invention wherein the endless moveable track consists of at least one conveyor car mounted upon a track.

After the residue has been transported out of the furnace system 28, disposition of it must be made. As shown in FIG. 1, the residue simply may be transported to the end of the conveyor belt 12 and disposed of by conventional means. Another method of disposing of the residue is shown in FIG. 6 wherein residue is brushed off 60 of the conveyor belt or other form of transportation and onto a second belt 54 from which the residue is taken for final disposition by appropriate means. The installation of a fan 56 to help remove the residue from any of the possible forms of conveyance is an option which may be exercised. When the residue has been removed, the endless belt returns to the hopper for receiving more waste. Rollers 58 are provided under the forward and reverse portions of the belt to hold up any slack which may exist in the belt.

It should be noted that any refractory material that is suitable for use may be applied to the furnace system 28 and any other portions of the invention which require such material.

Figure 4:
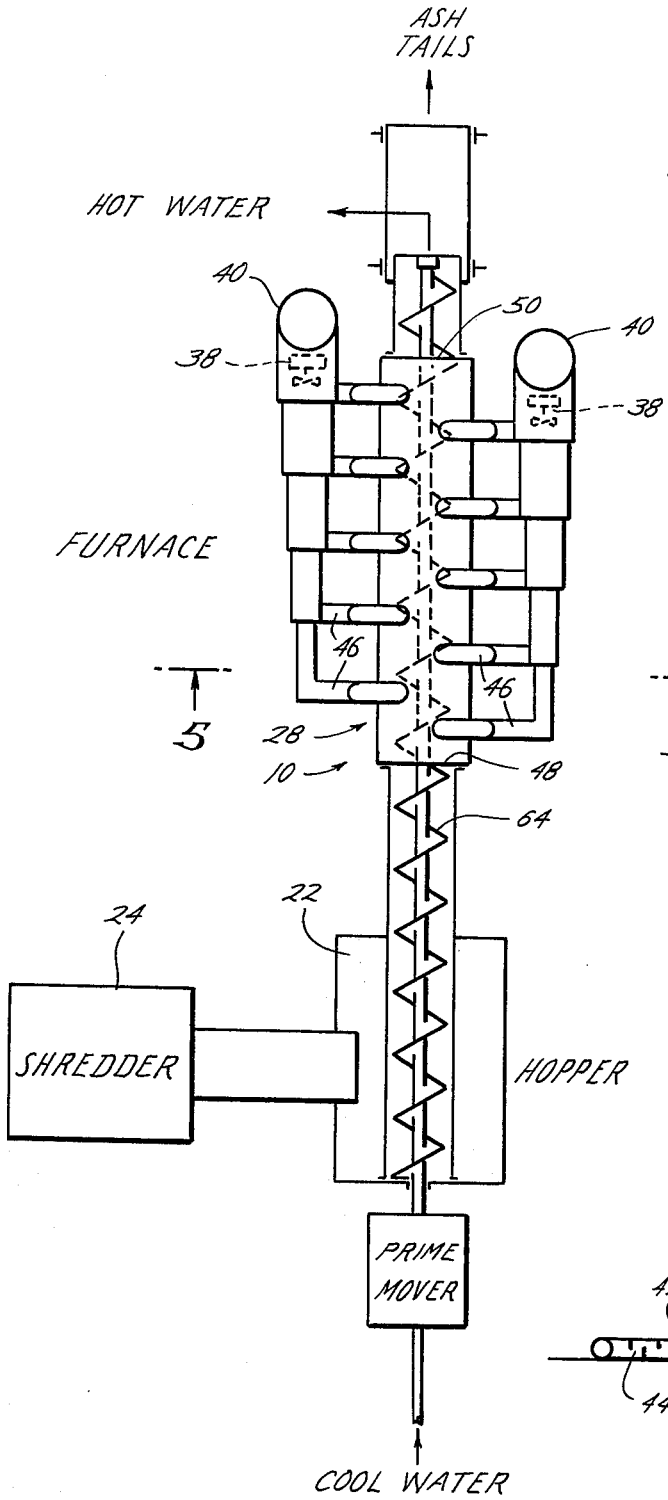
FIG. 4 is a top view of the present invention wherein the endless moveable track consists of an auger.
Figure 5:
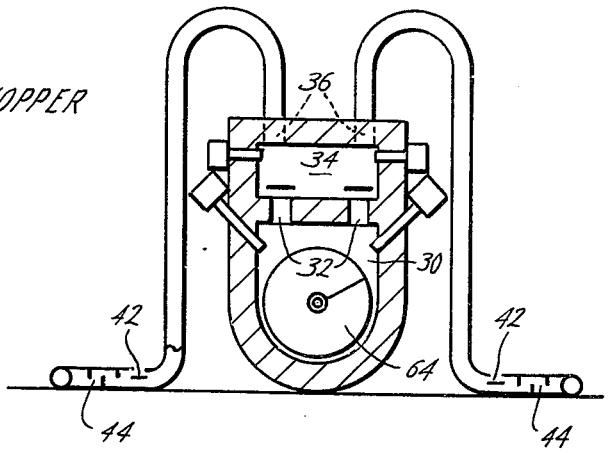
FIG. 5 is a front view, in section, of the furnace area of FIG. 4
Figure 7:
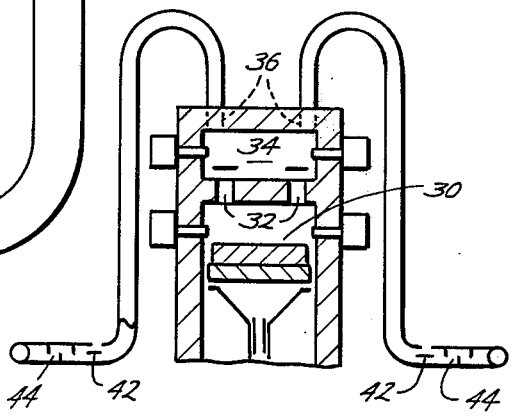
FIG. 7 is a front view, in section, of the furnace area of FIG. 6.

While the above description was based primarily on the use of a conveyor belt system, other systems are also usable and may be preferable. For example, an auger 64 conveyor is shown in FIGS. 4 and 5 while a car conveyor is shown in FIGS. 6 and 7, including the cars 62.

The presnt invention, therefore, is well adapted to carry out the objects and attain the ends and advantages mentioned as well as others inherent therein. While a presently-preferred embodiment of the invention is given for the purpose of disclosure, numerous changes in the details of construction and arrangement of parts may be made which will readily suggest themselves to those skilled in the art and which are encompassed within the spirit of the invention and the scope of the appended claims.

What is claimed is:

1. Apparatus for disposing of waste by substantially complete combustion thereof comprising:

furnace means for burning the waste;

conveyor means for moving said waste through said furnace means;

means for depositing said waste on said conveyor means for movement through said furnace means; and means for removing resulting residue from said conveyor means after said waste has passed through said furnace means;

said furnace means comprising an elongated primary burning area through which said conveyor means passes and an elongated secondary burner area directly above said primary burner area for burning any emissions remaining after burning in said primary burner area, said primary and secondary burner areas communicating with each other through vertical passageways therebetween longitudinally spaced along the length of said furnace means.

2. Apparatus as set forth in claim 1 comprising a plurality of outlets at longitudinally spaced intervals along said furnace means communicating with the upper confines of said secondary burner area for exit of the emissions remaining after secondary burning therein, said outlets being connected by conduit means to at least one smokestack.

3. Apparatus as set forth in claim 2 in which a fan is connected at said smokestack for creating a negative pressure to force said emissions through said outlets.

4. Apparatus as set forth in claim 3 including water scrubber means connected in said conduit means between said outlets and said smokestack to remove solids remaining in said emissions.

5. Apparatus as set forth in claim 1 including roller gates at the entrance and exit of said furnace means automatically adjustable to continuously engage the waste and residue on said conveyor means at said entrance and exit to prevent substantial escape of smoke and other products of combustion from said furnace means.

6. Apparatus as set forth in claim 5 including leveling means between said depositing means and said furnace means entrance to control the maximum height of waste entering said furnace means.

7. Apparatus as set forth in claim 5 in which said conveyor means comprises an endless oval shaped track on one side of which said waste is carried through said furnace means, the opposite side returning to said depositing means outside of said furnace means.

8. Apparatus as set forth in claim 7 in which said residue removing means comprises brush means engaging said residue on said track, as it exits from said furnace means, in a skewed direction, relative to movement of said track at that point.

9. Apparatus as set forth in claim 8 in which said waste is carried on cars along said oval track.

* * * * *